United States Patent [19]

Köllmann

[11] Patent Number: 5,022,873

[45] Date of Patent: Jun. 11, 1991

[54] GROUND CONDUCTOR SERIES TERMINAL

[75] Inventor: Hans J. Köllmann, Minden, Fed. Rep. of Germany

[73] Assignee: Wago Verwaltungsgesellschaft mbH, Minden, Fed. Rep. of Germany

[21] Appl. No.: 475,844

[22] Filed: Mar. 7, 1990

[51] Int. Cl.[5] ..... H01R 9/26

[52] U.S. Cl. ..... 439/716; 439/92

[58] Field of Search ..... 439/92, 211, 716

[56] References Cited

U.S. PATENT DOCUMENTS 3,135,572 6/1964 Curtis et al. ..... 439/716

3,157,453 11/1964 Lanczi ..... 439/716

4,421,367 12/1983 Shannon et al. ..... 439/211 X

*Primary Examiner*—Eugene F. Desmond

*Attorney, Agent, or Firm*—Salter & Michaelson

[57] ABSTRACT

This invention relates to a series terminal with one or more connection terminal units for ground conductors and with a contact base for the assembly rail, in order to use it as a ground conductor bus bar. To improve the electrical connection between the ground conductor connection terminal points and the assembly rail, and for better handling of the terminal, it is suggested that a contact clamp with a spring bow be used instead of the contact base, with the contact clamp being made in one part with the bus bar of the connection terminal points.

4 Claims, 1 Drawing Sheet

FIG. 1
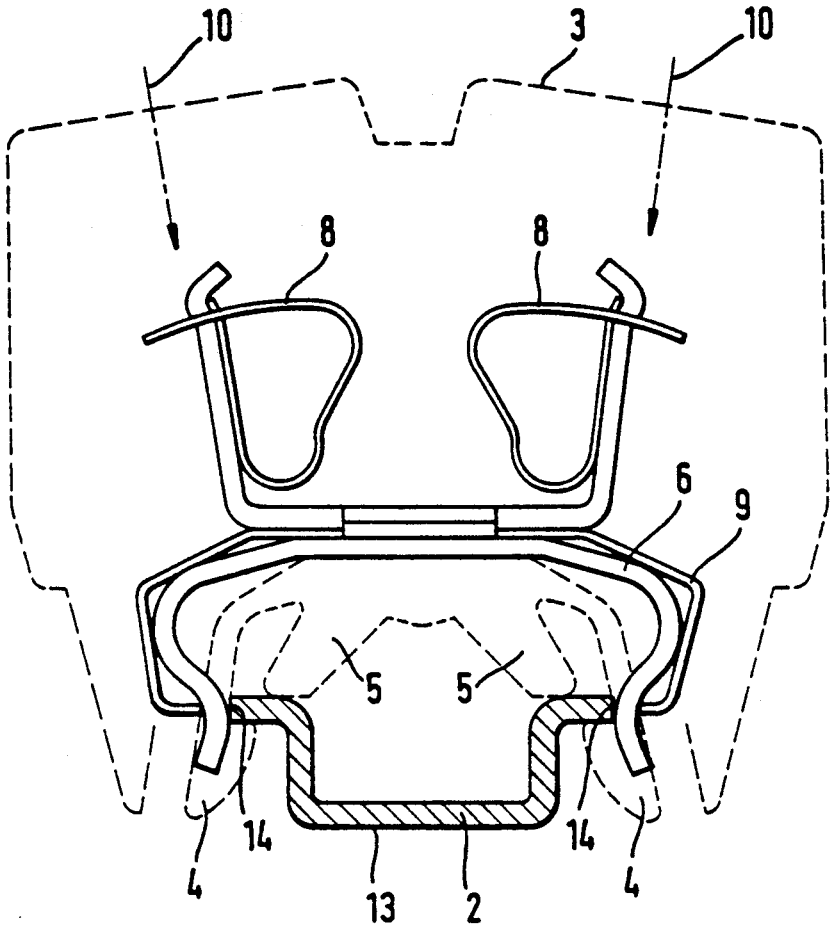
FIG. 2
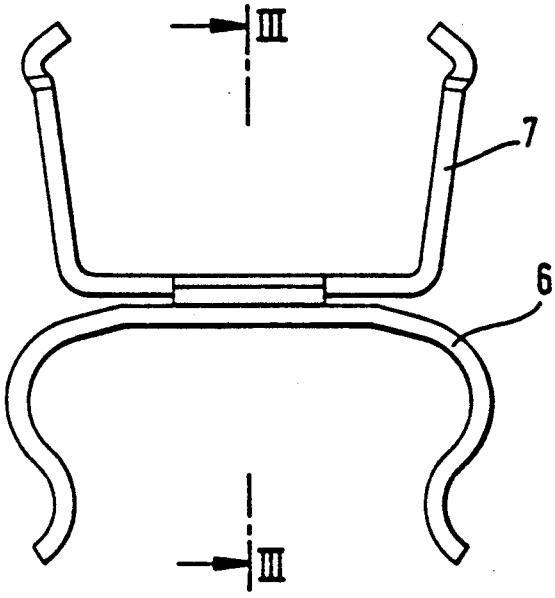
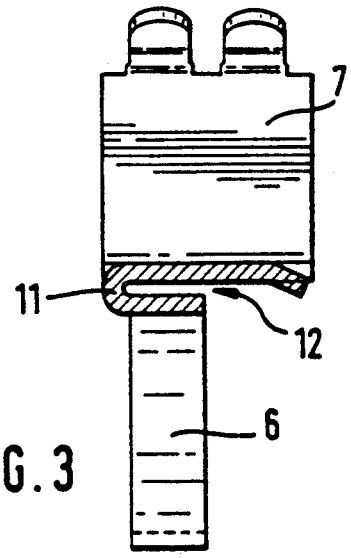
FIG. 3

GROUND CONDUCTOR SERIES TERMINAL

BACKGROUND AND SUMMARY OF THE INVENTION

This invention relates to series terminals with one or more connection terminal units or ground conductors and with a contact base for the assembly rail, in order to use this as a ground conductor bus bar.

Such series terminals with a contact base for the assembly rail are known not only for exclusive use as so-called ground conductor terminals, but also in combined design with other types of lead conductors, as for example with connection terminal units for phase conductors and/or neutral conductors. It is immaterial whether the connection terminal units are designed as screw connections, spring clamp connections, or by one of the other known connecting techniques. It is also known how to make such series terminals in very diverse design variants, for example as multiple-trunk terminals, as base terminals for component plugs, as initiator and actuator terminals, or the like.

However, it is a common feature of all of the series terminals of this type mentioned above that the ground conductor connection terminal unit or units automatically contact the assembly rail during the latching process of the series terminal, i.e., they contact the assembly rail through the contact base without additional manipulation, so that the conductive connection of the ground conductor connection terminal unit to the assembly rail is always assured. To prevent the possibility that this conductive connection might unintentionally be broken, it is required for such terminals to be able to be removed from the assembly rail only by using a tool, for example a screwdriver.

At the same time, however, it is also desirable for such series terminals to be movable laterally on the assembly rail in spite of the contact base to the assembly rail, for example, to be able to push individual terminals together on the assembly rail to make terminal blocks or terminal packs. Known terminals of this type do not usually permit this. The known terminals have a contact base made of a rigid, stiff material that is first set or hung on a flange of the assembly rail only by one end of the base when the terminal is latched to the assembly rail, by this end gripping around and under the flange. The terminal is then pivoted around this hung end of the contact base until the other end of the contact base is set on the opposite flange of the assembly rail and usually latched with it. This pivoting motion of the inherently stiff contact base presses the initially hung end of the contact base like a lever against the flange of the assembly rail, so that lateral motion on the assembly rail is generally no longer possible after the terminal is latched on.

The aforementioned pivoting motion that is carried out during the latching of the terminal, however, also has the drawback of the additional space required at the side next to the assembly rail, which is made necessary by the fact that the terminal first has to be set onto the assembly rail or hung in the flange of the assembly rail in a slanted position with only one end of its contact base. This additional required space is not available, or only with difficulty, in tightly fitted switchboxes or the like after wiring the terminals, so that subsequent removal and/or replacement of such ground conductor terminals runs into substantial difficulties, or may even be impossible.

The problems of current diversion through the contact base into the assembly rail are not convincingly solved with the known series terminals of this type. The possibility of high short-circuit currents requires good current conductivity of the contact base and of its connection to the power rail of the ground connection terminal unit, but this cannot be achieved by a suitable choice of material with the stiff designs of the contact bases necessary up to now. For this reason, it is always necessary to come to a compromise with the known series terminals of this type.

Therefore, it is the purpose of this invention to develop a terminal of the type defined initially with a contact base for the assembly rail that can be latched to an assembly rail and removed again with no problems and with no additional lateral space requirement, and which is also movable on the assembly rail, with an excellent conductive connection being guaranteed without compromise from the ground conductor connection terminal units to the assembly rail.

This problem is solved by a series terminal that is constructed in accordance with the subject invention.

According to the teaching of the invention, the contact base of conventional design is replaced by a so-called contact clamp that can be set down on the assembly rail vertically from above relative to the base surface of the assembly rail, and that contacts the assembly rail on outer surfaces that are likewise vertically oriented. The contact clamp is set down simultaneously with two clamp arms, so that a lever-like placement of the clamp is omitted, with the lateral space requirement necessary for this, and also the intensified force effects of the lever type.

Consequently, the material of the contact clamp no longer has to be stiff, and according to the teaching of the invention, it is made in one piece with the current bar of the ground conductor connection terminal unit, of a material with good current conductivity, for example electrolytic copper, so that the desired current conductivity is guaranteed in a desired manner, especially since the electrical contact resistances at the previously necessary mechanical connections between the bus bar of the connection terminal units and the previously used contact bases are eliminated.

Nevertheless, according to the teaching of the invention, in spite of the relatively soft, conductive material of the contact clamp, the necessary contact pressure between the contact clamp and the assembly rail is guaranteed, since the force of the clamp is essentially produced by a spring bow that grips the contact clamp.

This spring bow also guarantees the ability of the terminals pursuant to the invention to compensate for any dimensional tolerances of the assembly rails, such as those that may occur particularly also when moving the terminal clamps in the longitudinal direction. In the same way, the spring bow, that is made of high-strength chromium-nickel spring steel, for example, also guarantees the repeated latching and removal of the series terminals on assembly rails without the high current capacity of the connection between the ground conductor connection terminal unit and the assembly rail suffering from this.

In a particularly preferred embodiment of the invention the current bar and the contact clamp are adapted to be formed together from a piece of copper sheet or a material with similarly good conductivity in a manner which permits a bending pocket to be formed that holds and mechanically fastens the back of the spring bow.

For the contact surfaces of the contact clamp always to rest at the precise position on the intended outer surface of the assembly rail, it is desirable to fix the precise position of the series terminal on the assembly rail by structurally provided stops or the like. Such stops can be provided in the form of cracks or projections on the contact clamp itself, or they can consist exclusively of stops on the insulating case of the terminal.

In combination with the insulator latch bases of the terminal case, this achieves a clear separation of function. The insulator terminal case with its stops and latching bases accomplishes the fastening of the series terminal pursuant to the invention on the assembly rail in precise position, while the metal insert of the terminal, consisting of the ground conductor connection terminal units with their bus bar and the contact clamp with its spring bow, is responsible exclusively for the best possible electric contacting and power conduction, without the possibility of undesirable contact force transmission to the surrounding insulating case of the terminal, i.e., the metal insert is self-supporting as a friction-locked component.

DESCRIPTION OF THE DRAWING

An example of embodiment will be described below with reference to the drawings. The drawings show:

FIG. 1 a cross section through a series terminal pursuant to the invention,

FIG. 2 the bus bar with contact clamp pursuant to FIG. 1,

FIG. 3 the cross section III—III in FIG. 2.

DESCRIPTION OF THE INVENTION

FIG. 1 shows a series terminal pursuant to the invention latched onto a commercial assembly rail 2. The metal insert of the terminal is shown completely in solid lines. The insulating case and parts of it are shown in broken lines.

The outer contour 3 of the insulating case, which is latched to the assembly rail 2 by means of the insulator latching bases 4, and can be removed from the assembly rail only with a tool (for example, a screwdriver) by pushing one or both latching bases away from the assembly rail so that the latching of the bases with the flanges of the assembly rail is disengaged, can be seen in detail.

The precise height position of the terminal relative to the assembly rail is provided by the insulator stops 5, which in combination with the insulator latching bases 4 fasten the terminal in precise position, but permit moving the latched series terminal in the longitudinal direction of the assembly rail 2.

The aforementioned insulator latching bases 4 with the insulator stops 5 in the illustrated example of embodiment of the invention require about half of the total width of the terminal. Accordingly, the other half of the overall width of the terminal is available for arranging the contact clamps.

The contact clamp 6 is part of the metal insert which also comprises the current bar 7 with the cage tension springs 8 and the spring bow 9.

Ground conductors (now shown) introduced in the direction of the arrows 10 shown with dots and dashes are clamped against the current bar 7 by means of the cage tension springs 8, as is known and described in German Patent 27 06 482.0. In the example of embodiment illustrated, the current bar 7 is equipped with a total of four cage tension springs, as FIG. 3 shows.

The current bar 7 is made in one part with the contact clamp 6, of copper sheet with good conductivity, with the current bar 7 and the contact clamp 6 being connected to one another in each case through their side edges 11, and being bent relative to one another in such a way that the bending pocket 12 is formed (see FIG. 3).

The back of the spring bow 9 is inserted into this bending pocket, and is additionally fastened if necessary. The spring bow grips over the contact clamp 6 and presses both arms of the contact clamp against the outer surfaces 14 of the assembly rail 2 perpendicular to the base surface 13 (see FIG. 1).

It can be seen that the terminal illustrated is latched to the assembly rail from above, and can likewise be removed from the assembly rail in the vertical direction without requiring additional pivot space or the like at the side next to the assembly rail. It is also possible to move the terminal in the longitudinal direction of the assembly rail when it is latched on, and the electrical connection between the ground conductor terminal connectors 8/7 and the assembly rail 2 is optimized with no compromise.

I claim:

1. In a series terminal for use in connection with an elongated assembly rail of a type including a base portion, a pair of leg portions extending upwardly from opposite sides of said base portion, and a pair of side flange portions extending outwardly from the upper extremities of said leg portions terminating in elongated longitudinally extending side edges, said series terminal including a current bar which is electrically connectible to a ground connection, a contact base which is adapted to be latched to the assembly rail, and an insulator case including insulator latching bases for latching said insulator case to said assembly rail, the improvement comprising said contact base being integrally formed in a unitary construction with said current bar from a highly conductive metal and including a pair of spaced clamp ends which are receivable in clamping engagement with said opposite side edges so that said clamp ends are in substantially perpendicular relation to said base portion, said series terminal further comprising a resilient spring bow received on said contact base for resiliently urging the clamp ends thereof together in order to maintain said clamp ends in clamping engagement with said opposite side edges.

2. In the series terminal of claim 1, said contact base including a central back portion having opposite side edges and opposite ends, said clamp ends extending from opposite side edges of said central back portion, said current bar also including a central back portion having opposite side edges and opposite ends, the central back portion of said current bar being in closely spaced substantially parallel relation to the central back portion of said contact base, one end of the central back portion of said current bar being integrally connected to one end of the central back portion of said contact base, the central back portions of said current bar and said contact base cooperating to define a bending pocket therebetween, said spring bow passing through said bending pocket.

3. In the series terminal of claim 5, said insulator case including insulator stops which are engageable with said assembly rail for fixing the position of said series terminal thereon.

4. In the series terminal of claim 2, said insulator case including insulator stops which are engageable with said assembly rail for fixing the position of said series terminal thereon.

* * * * *